US007249958B2

(12) United States Patent
Ishikawa et al.

(10) Patent No.: US 7,249,958 B2
(45) **Date of Patent: *Jul. 31, 2007**

(54) CONNECTOR WITH A MOVING PLATE

(75) Inventors: Yoshiyuki Ishikawa, Yokkaichi (JP); Yoshio Okura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/405,136

(22) Filed: Apr. 17, 2006

(65) Prior Publication Data

US 2006/0270255 A1 Nov. 30, 2006

(30) Foreign Application Priority Data

May 27, 2005 (JP) ..... 2005-155716

(51) Int. Cl.
*H01R 13/44* (2006.01)

(52) U.S. Cl. ..... 439/141; 439/140; 439/157

(58) Field of Classification Search ..... 439/141, 439/271, 140, 597, 157
See application file for complete search history.

(56) References Cited

U.S. PATENT DOCUMENTS 4,797,116 A * 1/1989 Isohata et al. ..... 439/141
5,599,200 A * 2/1997 Yagi et al. ..... 439/381
6,183,275 B1 * 2/2001 Okura et al. ..... 439/157
6,830,485 B2 * 12/2004 Koehler et al. ..... 439/660
6,896,531 B2 * 5/2005 Bakker et al. ..... 439/140
2006/0154511 A1 * 7/2006 Okura ..... 439/372
2006/0178049 A1 * 8/2006 Ishikawa ..... 439/587

* cited by examiner

*Primary Examiner*—Tho D. Ta
*Assistant Examiner*—Vanessa Girardi
(74) *Attorney, Agent, or Firm*—Gerald E. Hespos; Anthony J. Casella

(57) ABSTRACT

A male housing (30) has a hood (32) and a rib (45) that projects forward in the hood (32). A moving plate (50) is disposed movably in the hood (32) and an insertion hole (62) is formed on a body (51) of the moving plate (50) for receiving the rib (45). Guide walls (64, 65) are formed on the periphery of the insertion hole (62). The moving plate (50) is pressed into the hood (32) from an initial position by a female housing (10). Peripheral sides of the moving plate (50) are guided by the hood (32) and peripheral surfaces of the rib (45) slide in contact with the guide walls (64, 65) to prevent the moving plate (50) from shaking.

17 Claims, 14 Drawing Sheets

CONNECTOR WITH A MOVING PLATE

BACKGROUND OF THE INVENTION

1. Field of the Invention

The present invention relates to a connector having a moving plate.

2. Description of the Related Art

U.S. Pat. No. 4,797,116 shows a connector assembly that has a male housing with a forwardly open hood and a female housing that can fit into the hood along a fit-in direction. Male terminal fittings are mounted in the male housing and have tabs that project into the hood. A moving plate is mounted in the hood for movement along the fit-in direction. The moving plate has holding holes that receive the tabs to maintain a correct alignment of the tabs and to prevent the tabs from being deformed by an external force. The moving plate is mounted in the hood so that the distal ends of the tabs are in the holding holes. The mating female housing can be fit in the hood of the male housing so that the opposed female and male terminal fittings connect to each other. The moving plate moves to the rear end of the hood as the female housing advances into the hood.

A peripheral wall is formed on the moving plate and slides in contact with the inner peripheral surface of the hood to guide the movement of the moving plate.

Male housings have become large to accommodate a large number of terminal fittings. Many such male housings are large in a height or width direction but narrow in the transverse direction. However, the above-described moving plate tends to shake longitudinally in such in a narrow male housing. The moving plate will shake less if the peripheral wall is long. However, an increase in the size of the peripheral wall of the moving plate requires a corresponding increase in the size of the hood. Consequently there is a concern that the mating female housing and the entire connector assembly must be larger to accommodate the longer peripheral wall of the moving plate.

The invention has been completed in view of the above-described situation. Therefore it is an object of the invention to provide a connector in which a moving plate is prevented from shaking when the moving plate moves, without enlarging the connector.

SUMMARY OF THE INVENTION

The invention relates to a connector assembly with a male housing that has a forwardly open hood. Male terminals are mounted in the housing and tabs of the male terminals project into the hood. The connector assembly also includes a female housing that can fit in the hood along a fit-in direction. A moving plate is fit in the hood and has holding holes that receive the tabs of the male terminals. The moving plate initially is at a position where distal ends of the male terminals are fit in the holding holes. However, the moving plate is pressed by the female housing and is pushed rearward in the hood along the fit-in direction. A rib is formed on the rear surface of the hood along the fit-in direction and a hole penetrates through the moving plate for receiving the rib.

The rib that projects from the rear surface of the hood slidably engages the insertion hole in the moving plate as the moving plate moves rearward in the hood along the fit-in direction. The sliding engagement of the rib in the insertion hole prevents the moving plate from tilting. Connectors that rely only on the peripheral wall of the moving plate to prevent the moving plate from tilting in the hood have a large distance between the tilt-preventing structures if the connector is large. However, the present invention also has the rib and the insertion hole. Therefore, the span between the portions that prevent tilting is short, and shaking of the moving plate is minimized or avoided. Furthermore the rib and the insertion hole are provided in a dead space. Therefore, the housings and the connector are not enlarged.

A guide wall preferably is formed on a periphery of the hole. The rib slides in contact with the guide wall to reduce shaking of the moving plate even further.

An elastic locking piece preferably is formed on a rear surface of the hood and penetrates through the hole of the moving plate. A to-be-locked portion is formed on the moving plate and is locked to the elastic locking piece to prevent the moving plate from moving rearward from an initial position. The to-be-locked portion preferably is formed on the guide wall. As a result, the male housing is compact and the to-be-locked claw is reinforced by the guide wall.

A fit-in groove preferably is formed on a fit-in surface or a front surface of the female housing for receiving the rib. The rib fits in the fit-in groove of the female housing when the female housing is fit in the male housing and prevents the female housing and the male housing from being bent or twisted.

DETAILED DESCRIPTION OF THE PREFERRED EMBODIMENTS

A connector assembly in accordance with the invention includes a male connector and a female connector identified respectively by the letters M and F in FIGS. 1 through 14. As explained herein, the female connector is configured to fit in the male connector M. Mating ends of the male and female connectors M and F are referred to herein as the front.

Figure 2:
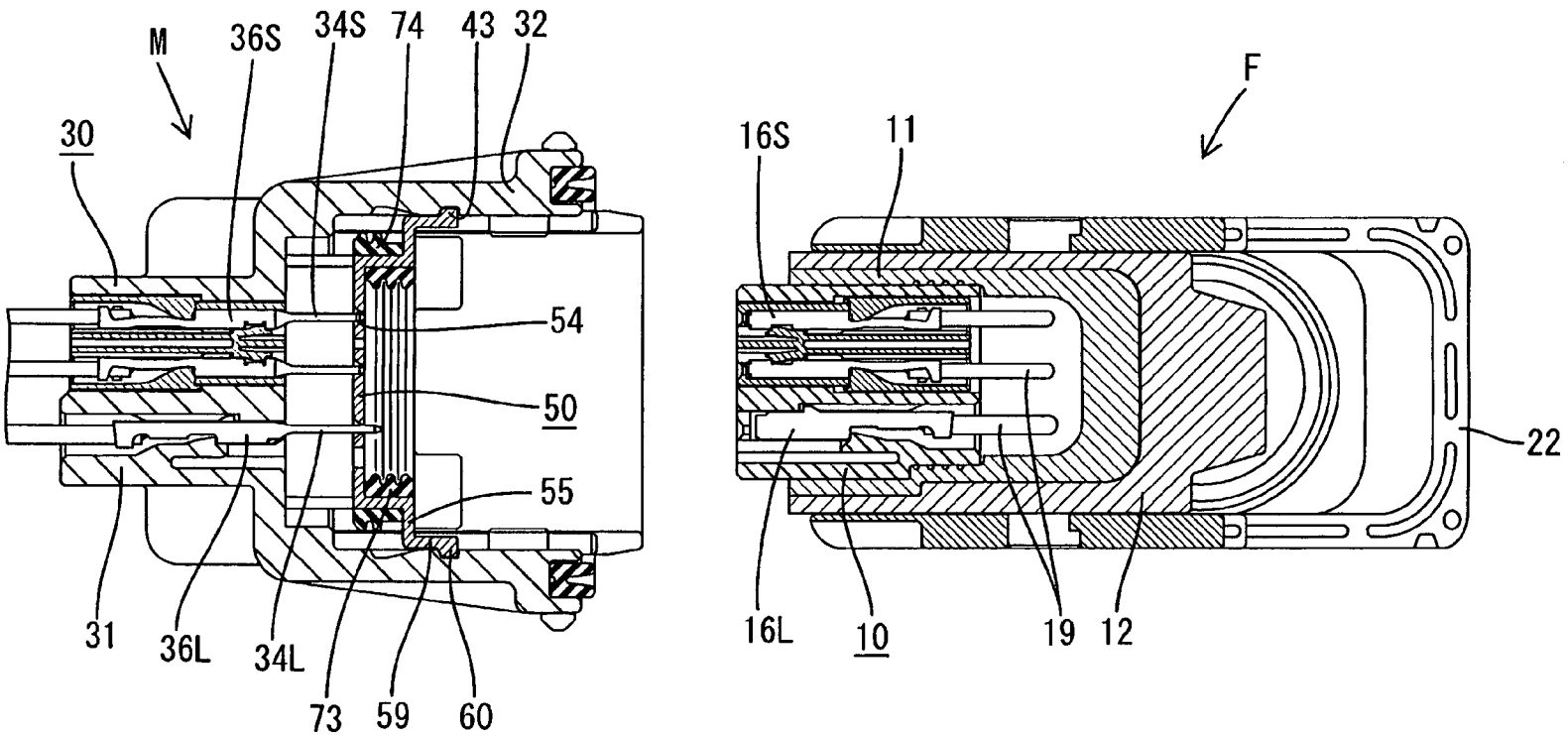
FIG. 2 is a plan sectional view showing the female and male connectors of FIG. 1 prior to being fit together.

As best shown in FIG. 2, the female connector F has a vertically long and narrow female housing 10, made of synthetic resin. A rubber grommet 11 is mounted on a peripheral surface of the female housing 10 to cover a rear portion of the female housing 10. A grommet cover 12 made of synthetic resin is mounted on the peripheral surface of the grommet 11, and a lever 22 is mounted on a peripheral surface of the grommet cover 12, for fitting the female connector F in the male connector M.

Figure 4:
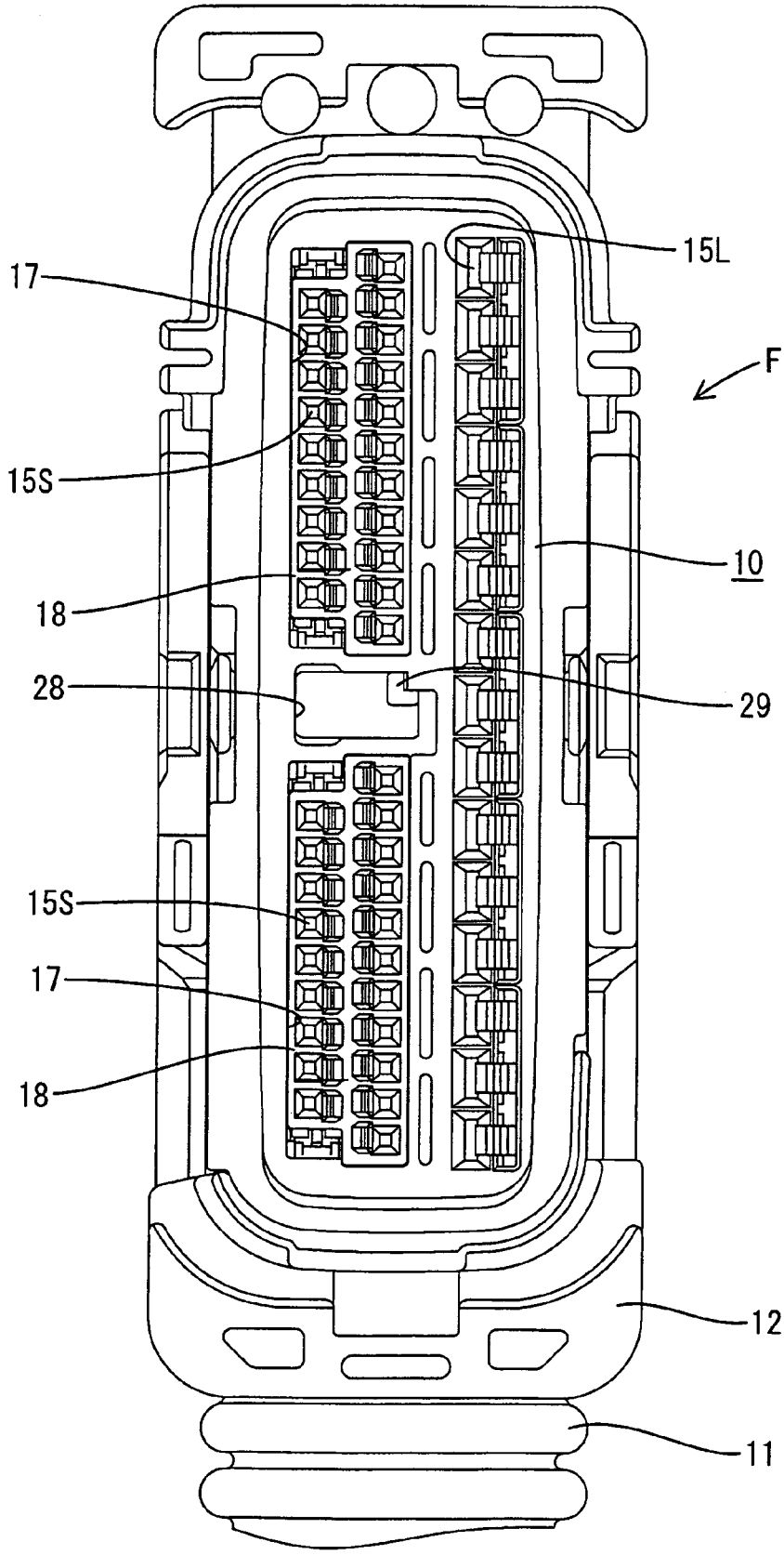
FIG. 4 is a front view of the female connector.

As shown in FIG. 4, large cavities 15L are arranged longitudinally in a row in a right-hand region of the female housing 10, as viewed from the front Large female terminals 16L are inserted respectively into the large cavities 15L. Upper and lower accommodation portions 17 are formed in a left-hand region of the female housing 10. Each accommodation portion 17 accommodates a sub-housing 18 that has cavities 15S for accommodating small female terminals 16S respectively.

Electric wires 19 are connected with the large and small female terminals 16L and the 16S and are drawn out of the rear surface of the female housing 10. The electric wires 19 then are guided down through an electric wire derivation portion 11A.

Figure 3:
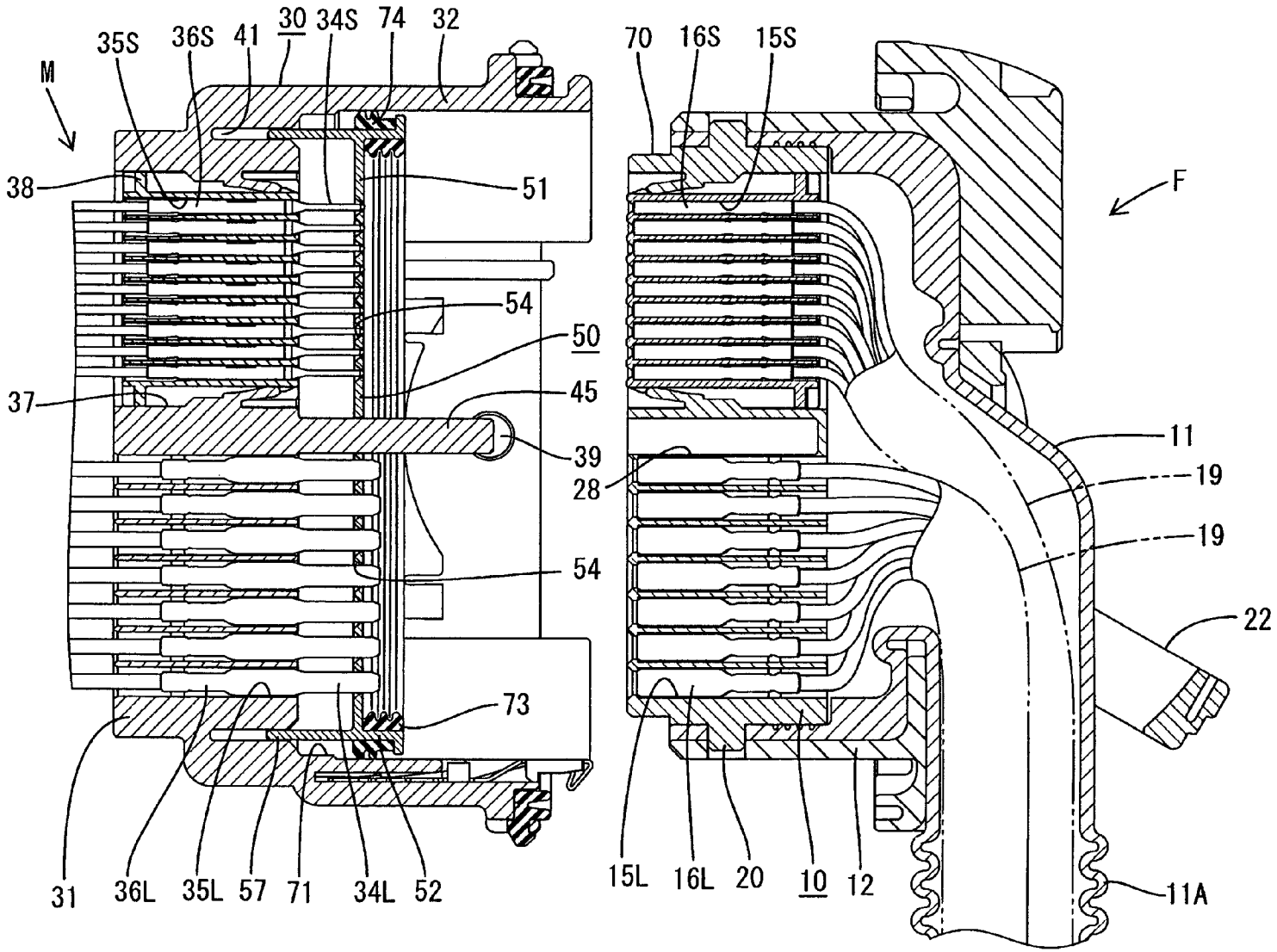
FIG. 3 is a vertical sectional view showing the female and male connectors of FIG. 1 prior to being fit together.

A hook 20 projects from the peripheral surface of the female housing 10, as shown in FIG. 3. The grommet cover 12 and the grommet 11 are engaged with the hook 20 and hence are secured on the female housing 10. The lever 22 then is mounted rotatably on the grommet cover 12.

The lever 22 has two arms 23 that extend from opposite ends of an operation portion 24. Thus, the lever 22 is generally gate-shaped. A cam groove 25 is formed at a wide portion at a distal side of each arm 23 and receives cam follower pins (see FIG. 1) on the male housing 30. A shaft hole 26 is formed in the wide portion of each arm 23. The shaft holes 26 receive shafts 27 that project from both side surfaces of the grommet cover 12. Thus, the lever 22 is supported rotatably by the shafts 27.

Figure 5:
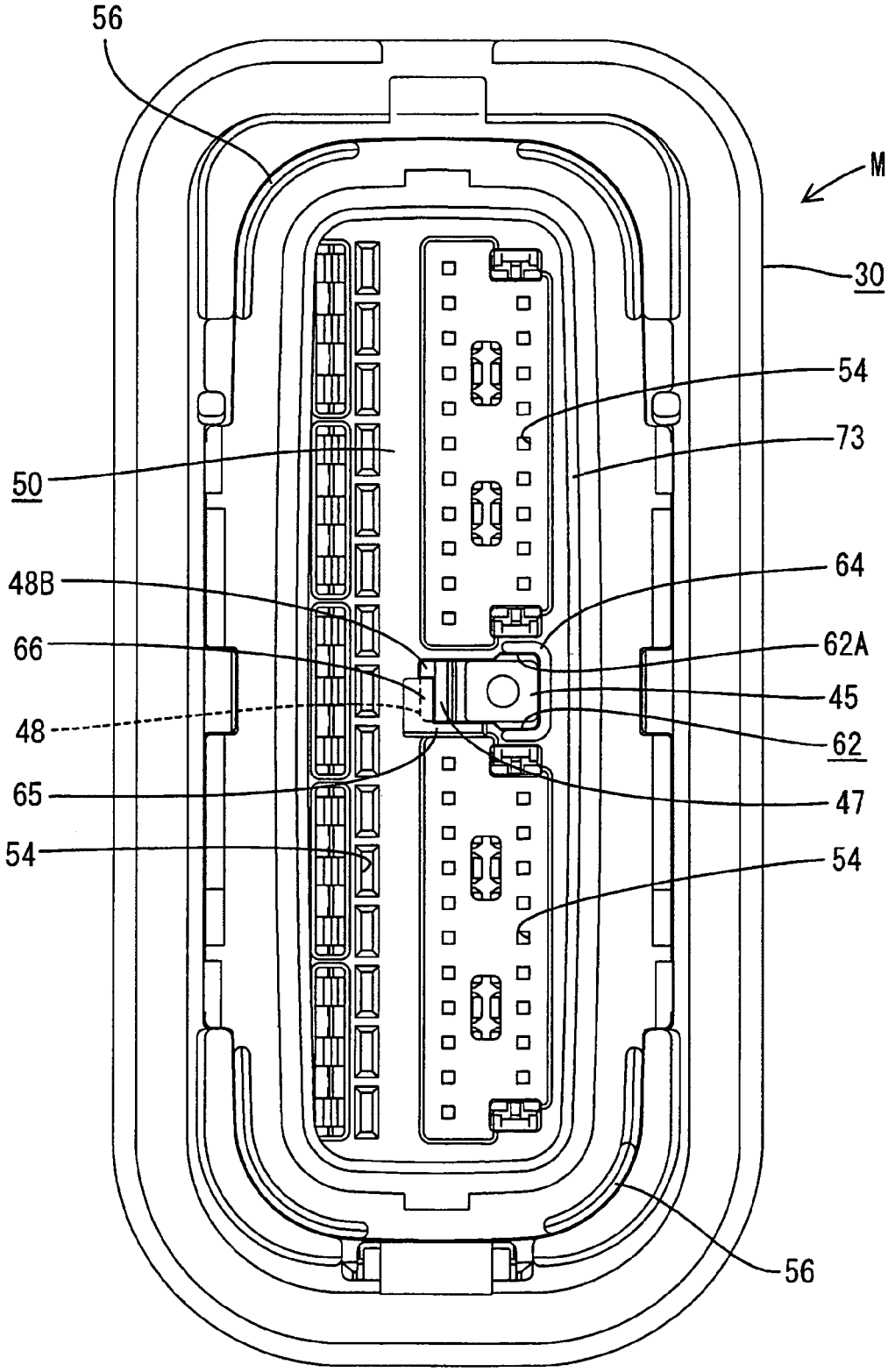
FIG. 5 is a front view of the male connector.
Figure 6:
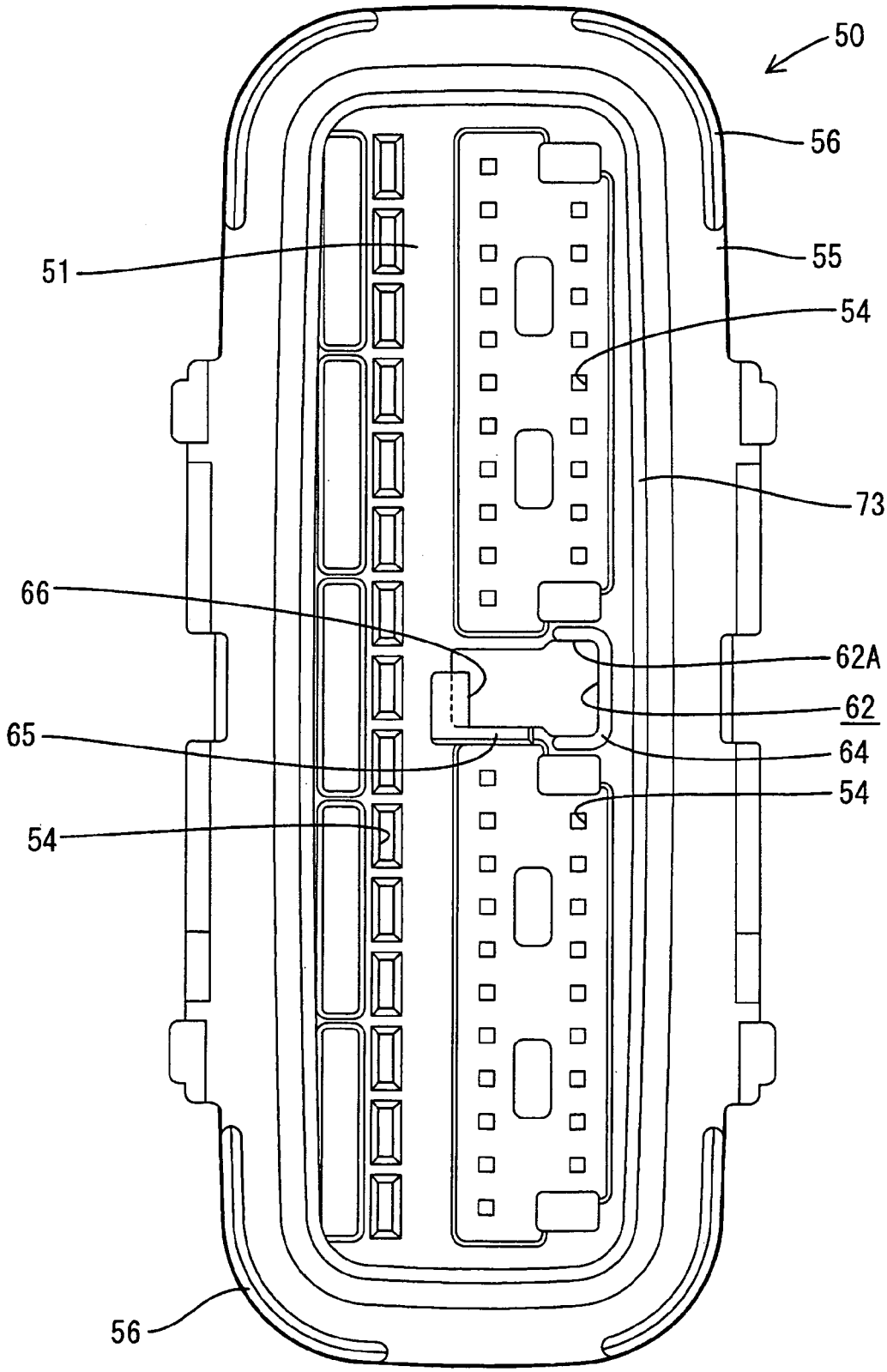
FIG. 6 is a front view of a moving plate.
Figure 7:
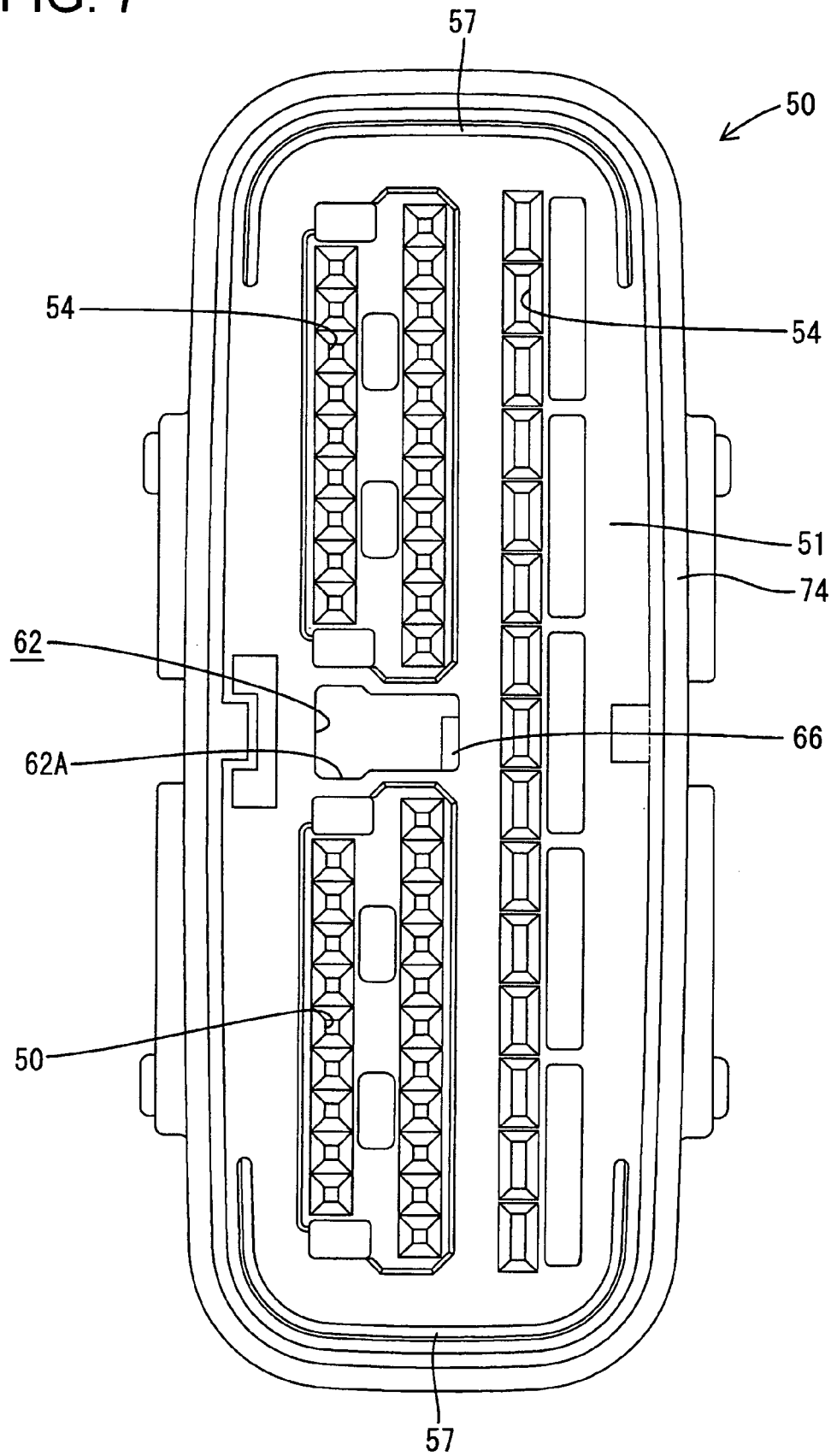
FIG. 7 is a rear view of the moving plate.

The male connector M has a male housing 30 made of synthetic resin. As shown in FIG. 3, the male housing 30 has a vertically long and narrow block-shaped terminal accommodation part 31 and an approximately square pillar-shaped hood 32. The hood 32 is larger than the terminal accommodation part 31 and is open in its front portion. The terminal accommodation part 31 has large cavities 35L formed in a widthwise row in a left-hand region of the male connector M, when viewed from the front, as shown in FIG. 5. Large male terminals 36L are accommodated respectively in the large cavities 35L, and tabs 34L of the large male terminals 36L project into the hood 32 from a rear portion thereof. Upper and lower accommodation chambers 37 are formed in a right-hand region of the terminal accommodation part 31. Each of the accommodation chambers 37 receives a sub-housing 38 with cavities 35S for small male terminals 36S. Tabs 34S of the small terminals 36S project from a front surface of the sub-housing 38 into the hood 32.

A follower pin 39 projects from each longer side surface in the inner periphery of the hood 32. The follower pins 39 engage the cam grooves 25 of the lever 22.

The connector also includes a moving plate 50 made of synthetic resin. As shown in FIGS. 2, 3 and 6 through 9, the moving plate 50 has a substantially flat vertically long and narrow main body 51 and a short peripheral wall 52 projects forward from the periphery of the body 51. Thus the moving plate 50 defines a shallow plate-shape. The front side of the female housing 10 can be fit in the moving plate 50. Holding holes 54 (see FIG. 6, 7) penetrate through the body 51 in a thickness direction. The holding holes 54 are disposed in correspondence to the positions of the cavities 35L, 35S of the terminal accommodation part 31.

A flange 55 extends outward continuously from a front edge of the peripheral wall 52 of the moving plate 50. Front projected walls 56 are formed on each of four corners formed on a front surface of the flange 55. The front projected walls 56 are rounded to fit tightly in four corners on the inner peripheral surface of the hood 32. U-shaped rear projected walls 57 (see FIGS. 7, 9) with rounded corners are formed at upper and lower peripheral edges of a rear surface of the body 51 so that the upper and lower rear projected walls 57 confront each other. An insertion groove 41 is formed on the rear wall of the hood 32 and receives the rear projected wall 57, as shown in FIG. 3.

Figure 12:
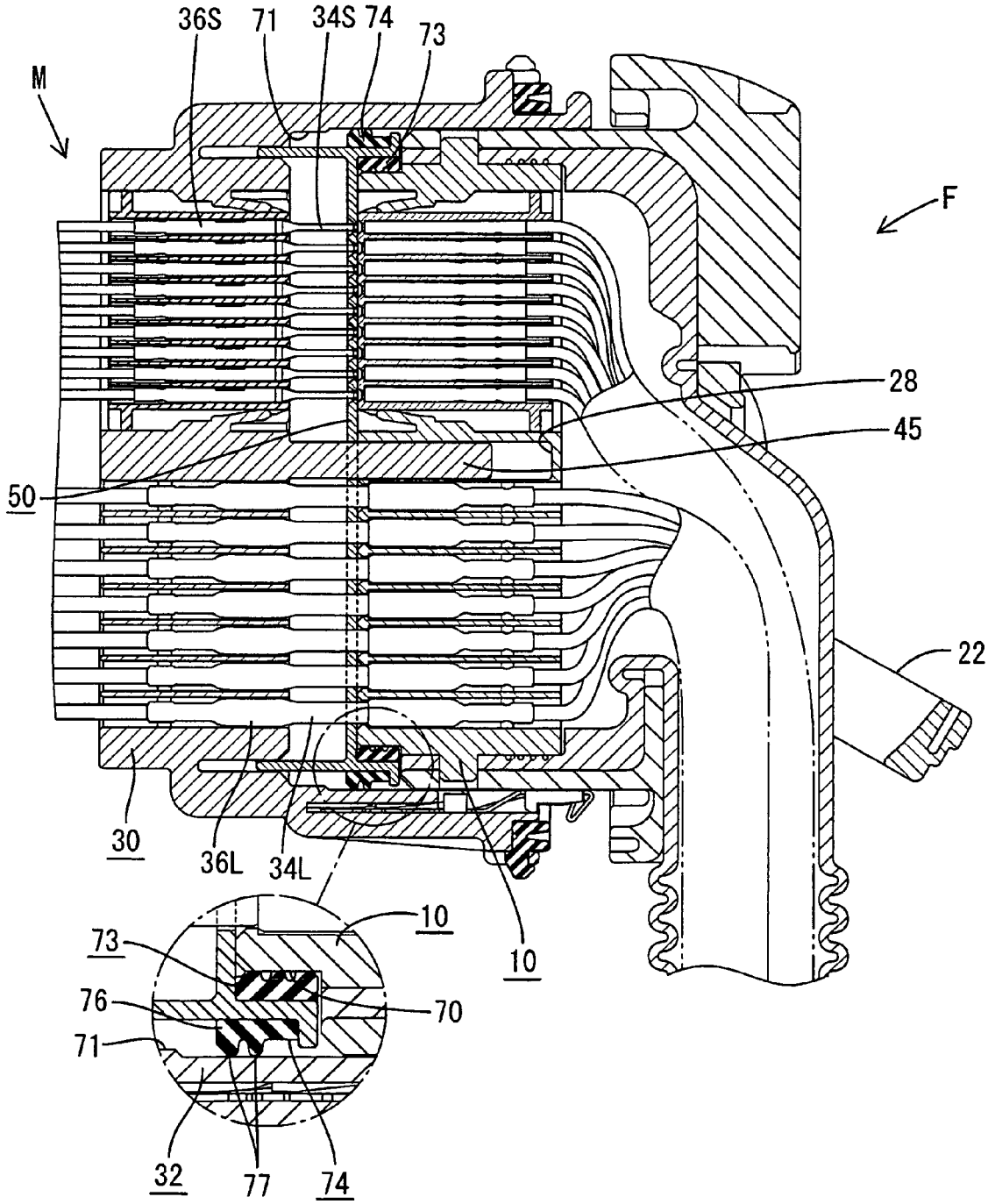
FIG. 12 is vertical sectional view showing the female housing mounted inside the moving plate.
Figure 13:
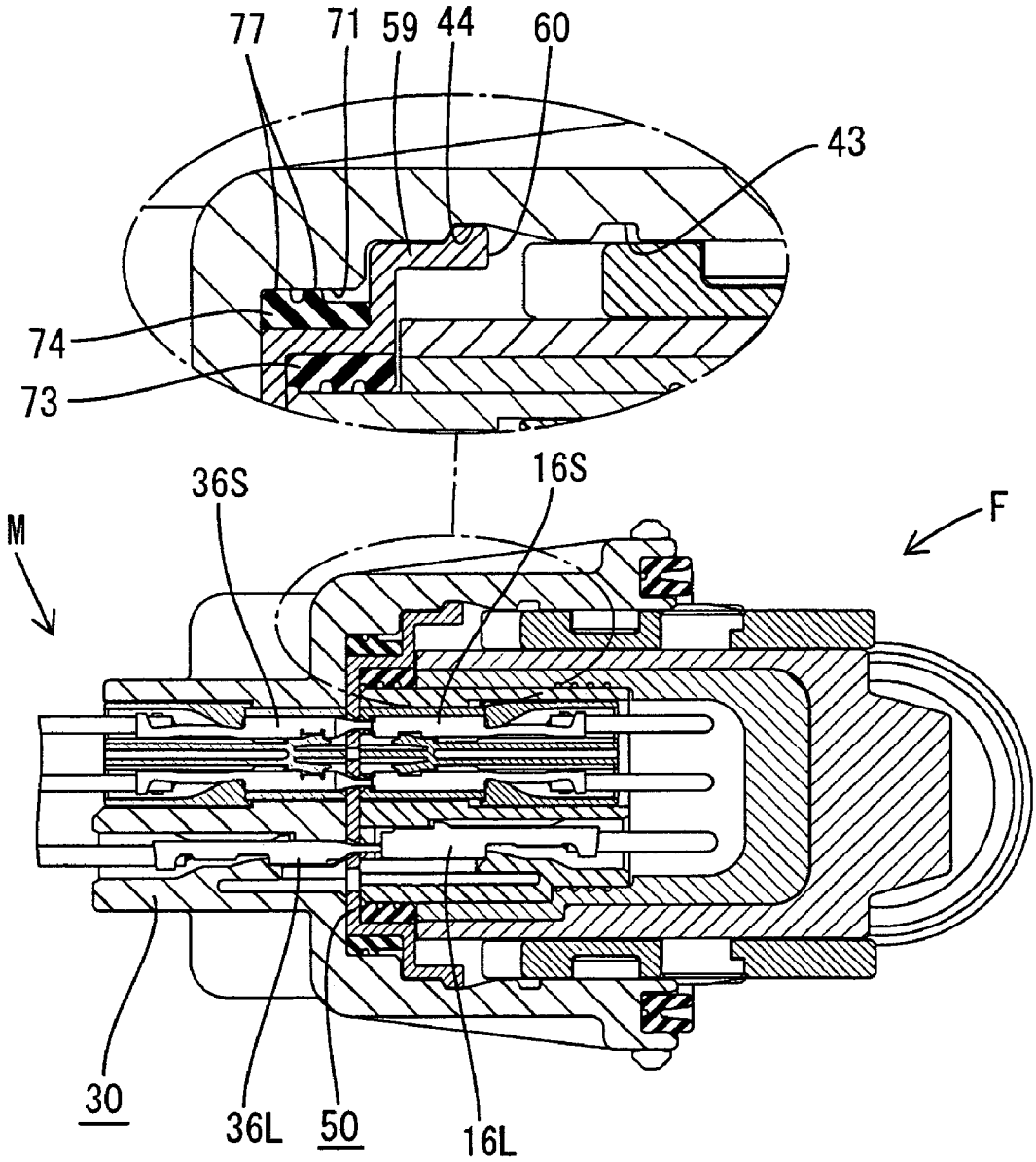
FIG. 13 is a plan sectional view showing the female housing fit in the male housing.
Figure 14:
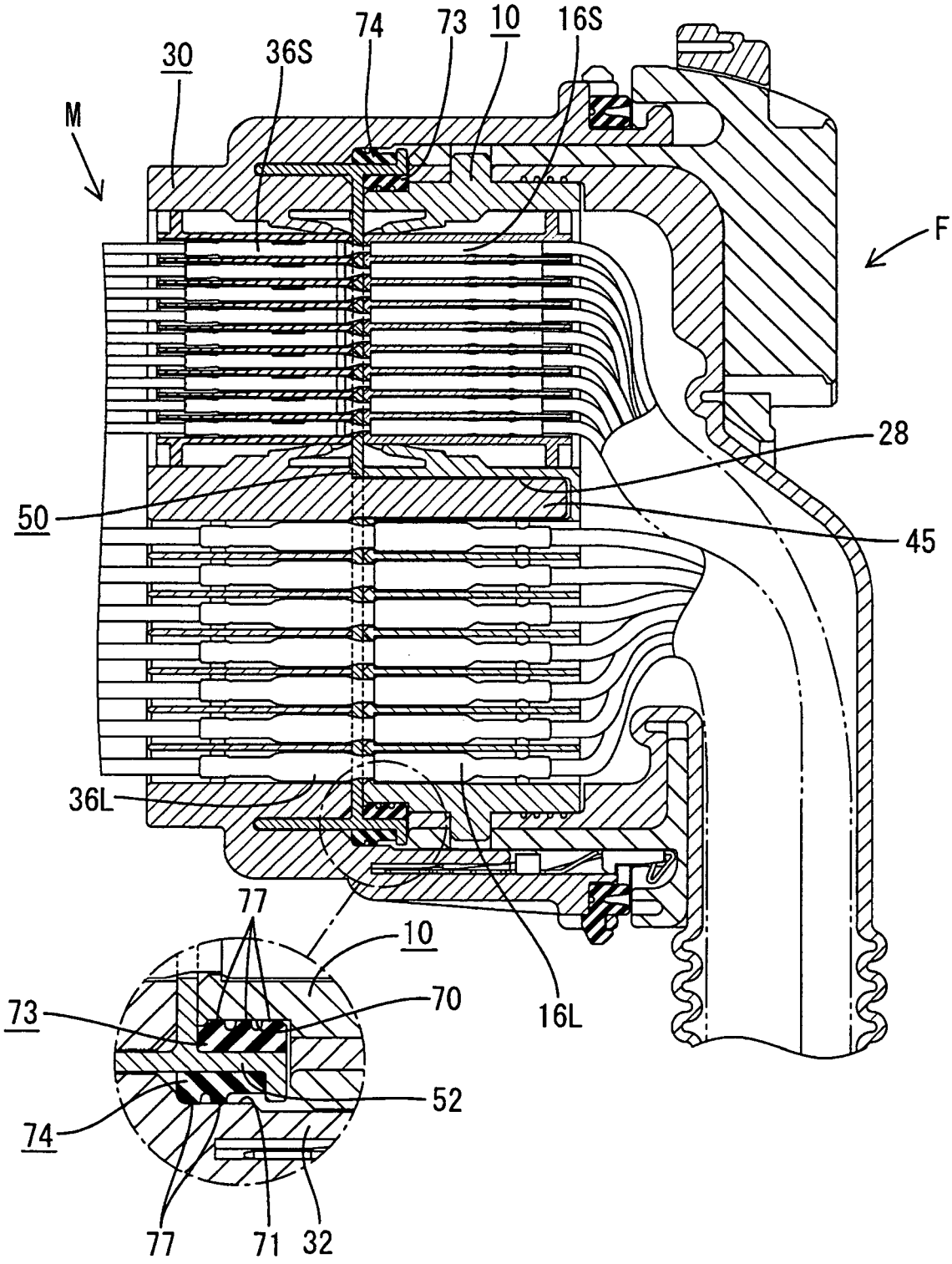
FIG. 14 is vertical sectional view showing the female housing fit in the male housing.

The moving plate 50 is inserted into the hood 32 from the front and is movable along the fit-in direction of the female housing 10 between an initial position (see FIGS. 11, 12) and a termination position (see FIGS. 13, 14). The body 51 of the moving plate 50 is forward of the rear surface of the hood 32 by a predetermined distance when the moving plate 50 is at the initial position. However, the body 51 of the moving plate 50 contacts the rear surface of the hood 32 when the moving plate 50 is at the termination position. The front projected walls 56 of the moving plate 50 slide in contact with the four corners of the inner peripheral surface of the hood 32 and the rear projected walls 57 slide in contact with the insertion groove 41 during the movement of the moving plate 50.

Distal ends of the tabs 34L, 34S of the large male terminals 36L and the small male terminals 36S are fit in the holding holes 54 when the moving plate 50 is at the initial position to prevent vertical and widthwise movement of the tabs 34L, 34S. However, proximal portions of the tabs 34L, 34S are in the holding holes 54 when the moving plate 50 is at the termination position.

Figure 8:
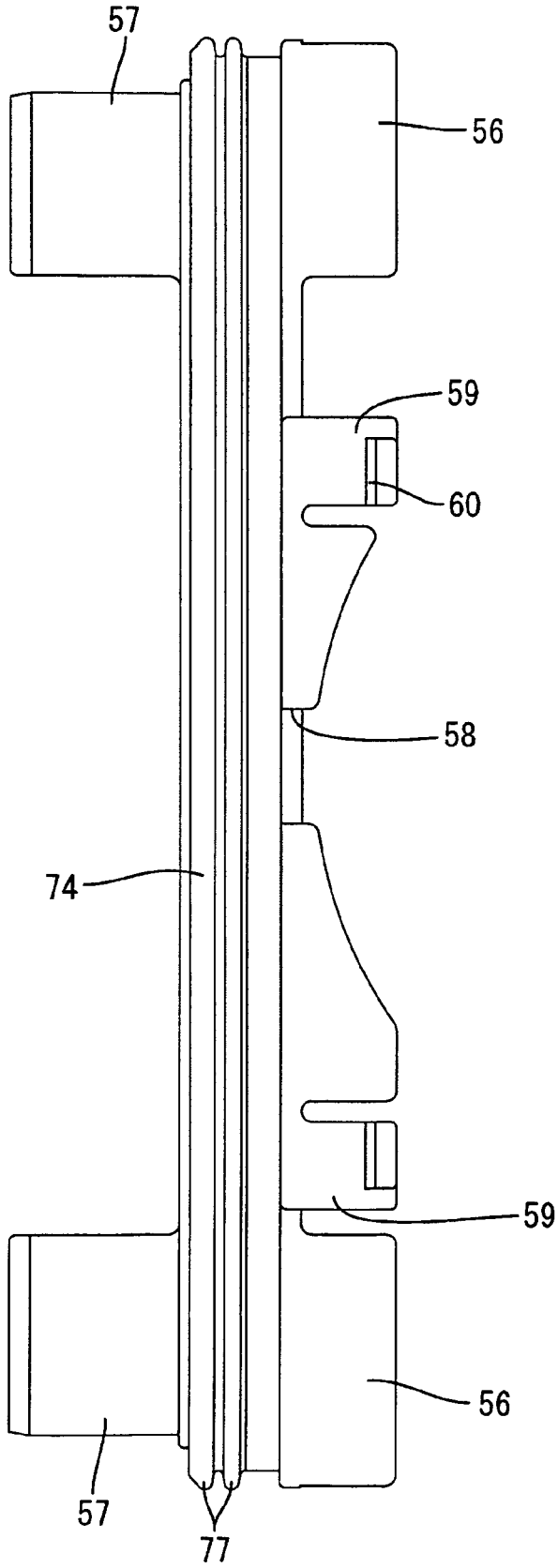
FIG. 8 is a side view of the moving plate.
Figure 9:
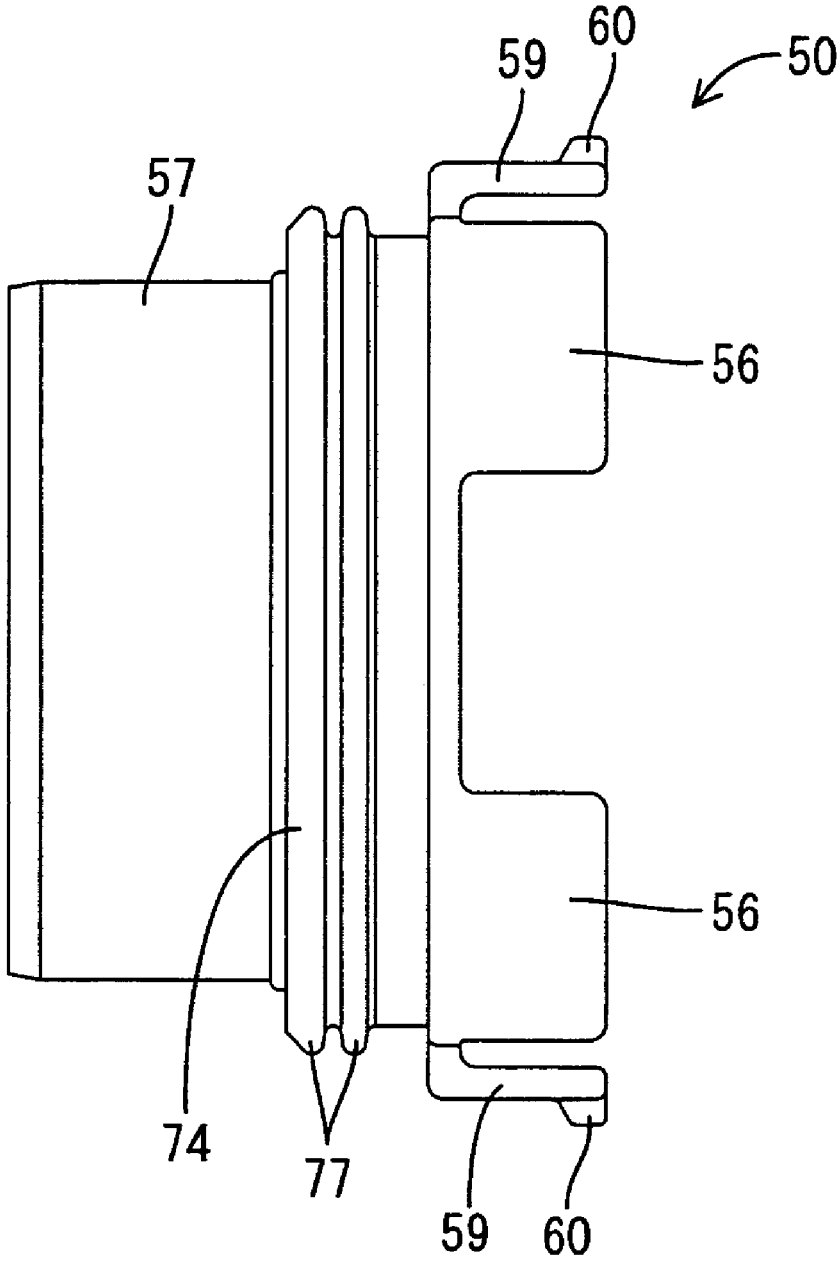
FIG. 9 is a plan view of the moving plate.

Elastic engaging pieces 59 project forward from upper left and right side edges and lower left and right side edges of the longer sides of the flange 55 of the moving plate 50, as shown in FIGS. 8 and 9. A left escape groove 58 is formed between the upper left and the lower left elastic engaging pieces 59 and a right escaping grove 58 is formed between the upper right and the lower right elastic engaging pieces 59 to allow the follower pins 39 to escape through the escape grooves 58 when the moving plate 50 is inserted into the hood 32.

The elastic engaging pieces 59 have the same shape and size. The left and right elastic engaging pieces 59 are symmetrical with respect to the center axis of the female housing 10 in the male housing 30. An engaging projection 60 projects out from the distal end of each of the elastic engaging pieces 59 and can deflect inwardly.

Figure 11:
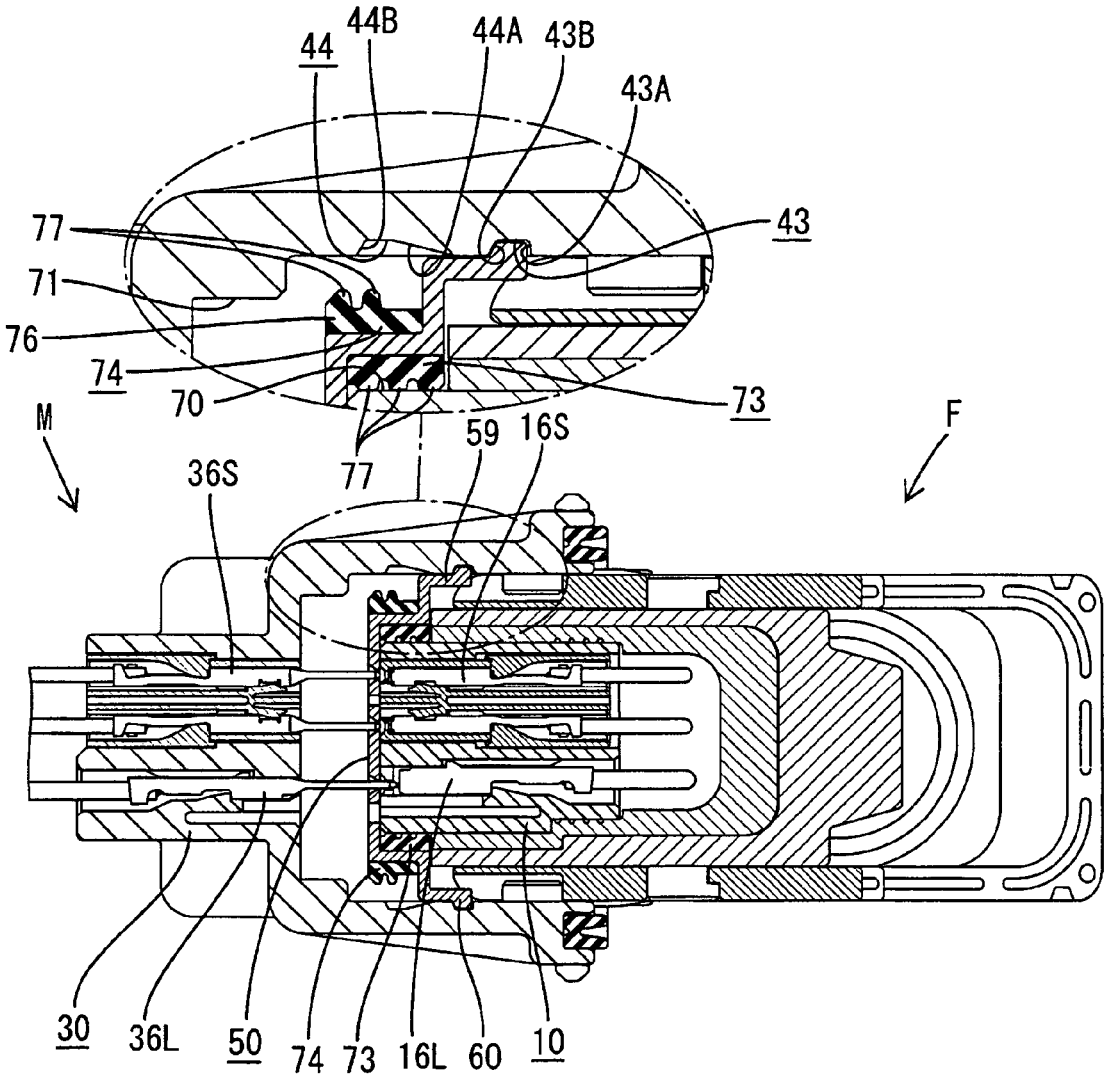
FIG. 11 is a plan sectional view showing the female housing mounted inside the moving plate.

First and second engaging holes 43 and 44 are formed on the inner peripheral surface of each of the longer sides of the hood 32 of the male housing 30 at positions rearward of the follower pins 39. The engaging holes 43 and 44 are configured to engage the elastic engaging pieces 59 of the moving plate 50. A vertical surface 43A is formed at a front side of the first engaging hole 43, as shown in FIG. 11, and is orthogonal to the fit-in direction of the female housing 10 into the male housing 30. A steep tapered surface 43B is formed at a rear side of the first engaging hole 43. A gentle tapered surface 44A is formed at the front side of the second engaging hole 44, whereas a steep tapered surface 44B is formed at a rear side of the second engaging hole 44.

The engaging projections 60 of the elastic engaging pieces 59 of the moving plate 50 fit in the first engaging holes 43 of the hood 32 to hold the moving plate 50 at the initial position. The steeply tapered surfaces 44B at the rear side of the first engaging holes 43 constitute a semi-locking construction. Thus, the moving plate 50 can move to the termination position when a rearward pressing force is applied to the moving plate 50.

The engaging projections 60 of the elastic engaging pieces 59 fit in the second engaging holes 44 to hold the moving plate 50 at the termination position. The gentle tapered surfaces 44A are formed at the front sides of the second engaging holes 44. Thus, a forward force can return the moving plate 50 to the initial position.

Figure 1:
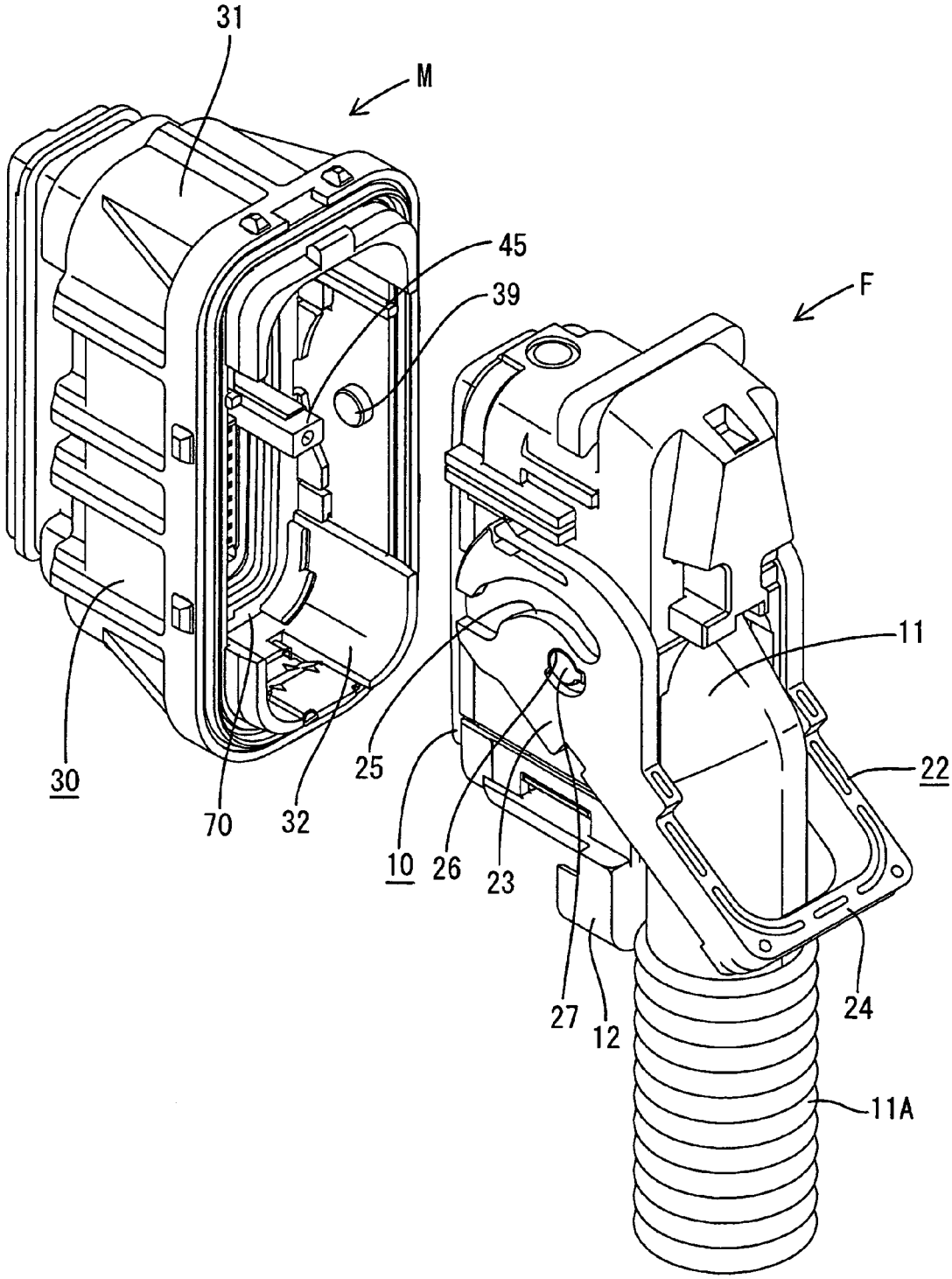
FIG. 1 is a perspective view showing female and male connectors according to the invention fit together.
Figure 10:
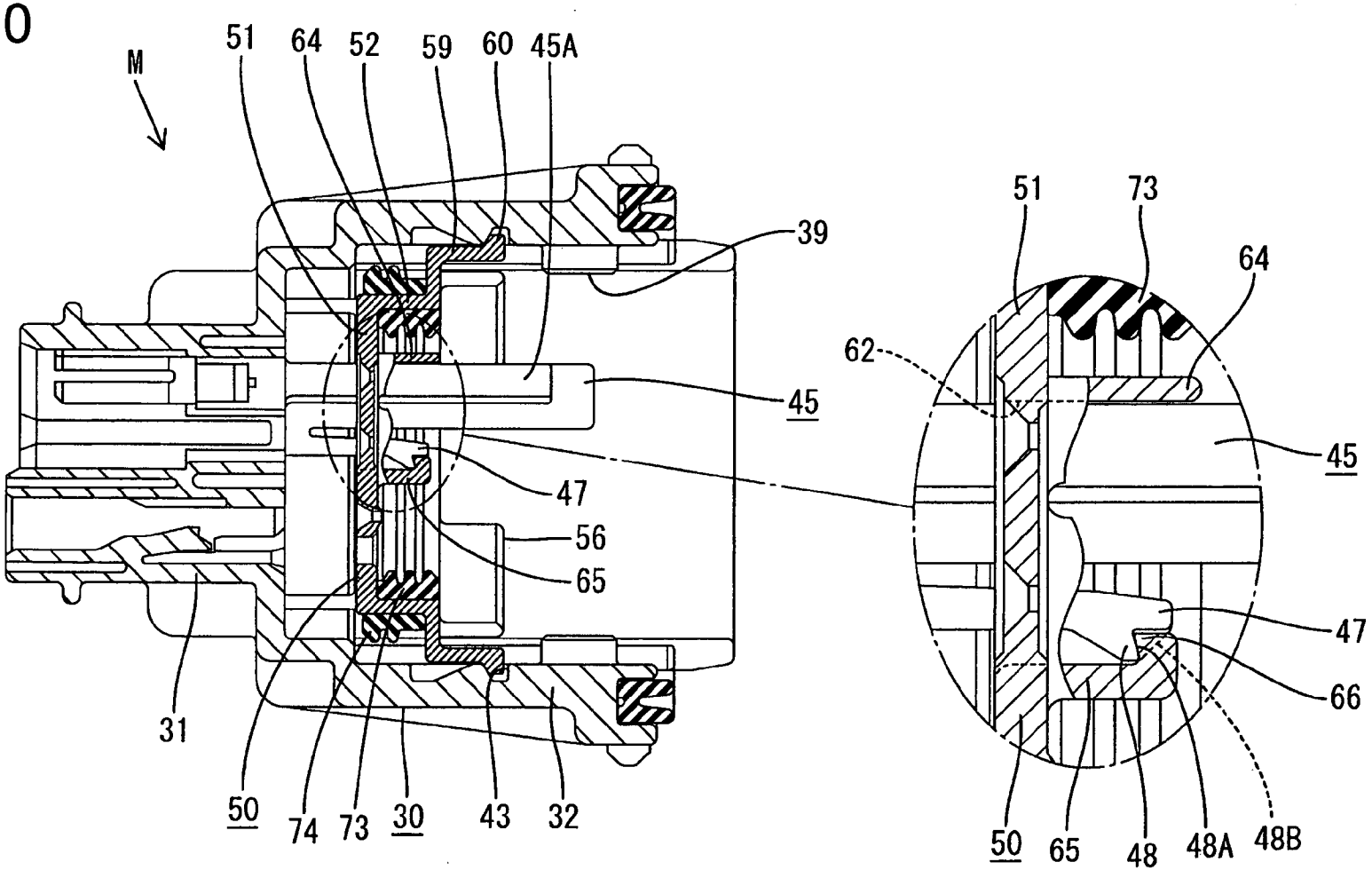
FIG. 10 is a plan sectional view showing the moving plate mounted at an initial position.

A rib 45 projects forward from the rear surface of the hood 32 of the male housing 30, as shown in FIG. 10. More specifically, the rib 45 extends forward from the front surface of the terminal accommodation part 31 at a position between the upper and lower accommodation chambers 37. As shown in FIG. 5, the rib 45 is a rectangular pillar that is wide when viewed from the front. The distal end of the rib 45 is substantially longitudinally coincident with the follower pin 39, as shown in FIGS. 1 and 10. The width of the rib 45 is enlarged slightly from its proximal end to a position near its distal end in the right-hand region of the rib 45, as viewed from the front.

A locking piece 47 is formed forward on the rear surface of the hood 32 at a position adjacent to the rib 45, as shown in FIG. 10, to prevent the moving plate 50 from being pressed from the initial position. The locking piece 47 has a width equal to the width of the narrow portion of the rib 45 and a height approximately half of the height of the rib 45. Distal parts of the locking piece 47 are elastically deformable in directions towards and away from the rib 45. A locking projection 48 is formed on a distal portion of the locking piece 47 at a side opposite to the rib 45. With reference to FIGS. 5 and 10, an inversely tapered locking surface 48A is formed in a region occupying about ⅔ of the lower portion of the front surface of the locking projection 48. A tapered unlocking surface 48B is formed in the remaining lower portion of the locking projection 48.

An insertion hole 62 is formed on the body 51 of the moving plate 50 for receiving the rib 45 and the locking piece 47. As shown in FIG. 5, the insertion hole 62 is only just large enough to allow passage of the rib 45 and the locking piece 47.

The insertion hole 62 is formed to define a wide portion 62A at a right side of the insertion hole 62, as viewed from the front, and a U-shaped guide wall 64 is formed on the periphery of the side portion 62A. The guide wall 64 is as high as the peripheral wall 52 of the moving plate 50. Three side surfaces of a widened portion 45A of the rib 45 slide in contact with the inner peripheral surface of the guide wall 64.

An L-shaped guide wall 65 is formed in a lower region from a lower edge of the narrow side of the insertion hole 62 to a left edge thereof and is a little lower than the guide wall 64. A surface corresponding to the narrowed portion of the rib 45 slides in contact with an inner surface of the lower side of the guide wall 64.

A to-be-locked claw 66 is formed at a projected end of the left part of the guide wall 65 and can be locked to the locking surface 48A of the locking piece 47.

The non symmetrical shape of the rib 45 prevents an erroneous connection of the female and male housings 10 and 30. A fit-in groove 28 is formed on the front surface of the female housing 10 at a position corresponding to the position of the rib 45, as shown in FIG. 4, and can receive the distal end of the rib 45.

An unlocking portion 29 is formed at the right upper corner of the fit-in groove 28, as viewed from the front in FIG. 4, and is configured for contacting the unlocking surface 48B of the locking projection 48 of the locking piece 47 on the moving plate 50. More specifically, the unlocking portion 29 presses the unlocking surface 48B of the locking projection 48 as the female housing 10 advances into the hood 32 and deforms the locking piece 47 elastically. Thus, the unlocking surface 48B of the locking projection 48 is unlocked from the to-be-locked claw 66.

The front part of the female housing 10 to be fit in the moving plate 50 is cross-sectionally smaller than the rear part, and a sealing surface 70 is defined around the periphery of the cross-sectionally small front part of the female housing 10, as shown in FIG. 3. The sealing surface 70 is opposed to but spaced from the inner peripheral surface of the peripheral wall 52 when the female housing 10 is pressed into the rear portion of the moving plate 50, as shown in FIG. 12.

Rear portions of the hood 32 of the male housing 30 are stepped inward to form a sealing surface 71, as shown in FIG. 3. The sealing surface 71 of the hood 32 is opposed to but spaced from the outer surface of the peripheral wall 52 of the moving plate 50 when the moving plate 50 is pressed to the termination position, as shown in FIG. 14. Thus, a gap is defined between the sealing surface 71 and the peripheral wall 52.

An inner sealing ring 73 is disposed on the inner side of the peripheral wall 52 of the moving plate 50 for sealing the gap between the female and male housings 10 and 30. More specifically, the inner sealing ring 73 extends from the front surface of the body 51 of the moving plate 50 to the distal end of the peripheral wall 52 thereof. An outer sealing ring 74 is disposed on the outer side of the peripheral wall 52 of the moving plate 50 for sealing the gap between the female and male housings 10 and the male 30. More specifically, the outer sealing ring 74 extends from the flange 55 to the rear surface of the body 51 of the moving plate 50.

The moving plate 50 is made of a hard synthetic resin, whereas the sealing rings 73 and 74 are made of an elastomer. The inner and outer sealing rings 73 and 74 are formed integrally with the moving plate 50 by two-color injection molding. A two-color injection molder forms an integral molded product from different materials, and specifically an integral matrix of the elastomer and the hard synthetic resin.

The inner and outer sealing rings 73 and 74 each have an annular body 76. Lips 77 are formed on each annular body 76 and project away from the adjacent surface of the moving plate 50. The thicknesses of the annular bodies 76 and the heights of the lips 77 are identical on the inner and outer sealing rings 73 and 74. However, the inner sealing ring 73 has three lips 77, whereas the outer sealing ring 74 has only two lips 77.

The moving plate 50 and the housings 10, 30 are dimensioned so that the lips 77 of the outer sealing ring 74 are depressed by the sealing surface 71 of the male housing 30 less than lips 77 of the inner sealing ring 73 are depressed by the sealing surface 70 of the female housing 10. Thus, a frictional force between the outer sealing ring 74 and the sealing surface 71 of the male housing 30 is less than a frictional force between the inner sealing ring 73 and the sealing surface 70 of the female housing 10.

The moving plate 50 initially is inserted into the hood 32 of the male housing 30 from the front and is held at the initial position shown FIGS. 2 and 3. As a result, the engaging projections 60 of the elastic engaging pieces 59 engage the corresponding first engaging holes 43 to prevent the moving plate 50 from moving rearward from the initial position. The rear projected walls 57 at the upper and lower peripheral edges of the rear surface of the body 51 of the moving plate 50 enter the insertion groove 41 at the rear of the hood 32. Additionally, the rib 45 and the locking piece 47 penetrate through the insertion hole 62 so that the locking surface 48A of the locking projection 48 of the locking piece 47 engages the to-be-locked claw 66, as shown in FIG. 10, to prevent the moving plate 50 from being pressed further rearward in the male housing 30.

The female housing 10 then is fit into the moving plate 50 in the hood 32 of the male housing 30 so that the rib 45 of the male housing 30 aligns with and enters the fit-in groove 28 of the female housing 10. The sealing surface 70 at the front end of the female housing 10 moves into the inner sealing ring 73 at the last stage of fitting the female housing 10 into the moving plate 50. As a result, the sealing surface 70 depresses the three lips 77 of the inner sealing ring 73, as shown in FIGS. 11 and 12. The unlocking portion 29 at one corner of the fit-in groove 28 of the female housing 10 presses the unlocking surface 48B of the locking projection 48 of the locking piece 47 substantially when the front surface of the female housing 10 contacts the body 51 of the moving plate 50, thereby forcibly elastically deforming the locking piece 47. As a result, the unlocking portion 29 unlocks the locking piece 47 from the to-be-locked claw 66 so that the moving plate 50 can be pressed towards the rear side of the male housing 30.

At this time, the follower pins 39 of the male housing 30 enter the cam grooves 25 of the lever 22 mounted on the female connector F. The lever 22 then is rotated so that the follower pins 39 move along the cam grooves 25 to move the female housing 10 to the rear of the hood 32. The operational force generated by the lever 22 exceeds the locking force of the semi-locking construction defined by the elastic engaging pieces 59 and the first engaging holes 43. As a result, the elastic engaging pieces 59 deform elastically and disengage from the first engaging hole 43 so that the moving plate 50 is pressed towards the termination position inside the hood 32.

At that time, the front projected walls 56 on the periphery of the moving plate 50 slide in contact with the four corners of the inner peripheral surface of the hood 32. Further the rear projected walls 57 on the upper and lower peripheral edges of the rear surface of the body 51 slide in contact with the insertion grooves 41 formed in the rear end of the hood 32. In addition, the three peripheral surfaces of the rib 45 that projects forward in the hood 32 slide in contact with the inner peripheral surface of the guide walls 64, 65 formed on the periphery of the insertion hole 62 of the moving plate 50. As a result, the moving plate 50 is pressed smoothly into the male housing 30 with minimal shaking.

The outer sealing ring 74 enters the sealing surface 71 of the male housing 30 as the moving plate 50 approaches the termination position. As a result, the sealing surface 71 depresses the two lips 77. The body 51 of the moving plate 50 contacts the rear surface of the hood 32 when the lever 22 reaches the termination position, and the engaging projection 60 of the elastic engaging piece 59 engages in the second engaging hole 44, as shown in FIGS. 13 and 14. As a result, the lever 22 is locked, and the female and male housings 10 and 30 are held in a normal fit-in state.

The tabs 34L and 34S of the male terminals 36L and 36S accommodated in the male housing 30 penetrate the corresponding holding holes 54 of the moving plate 50. As a result, the tabs 34L and 34S are held straight and connect to the mating female terminals 16L and 16S. The inner sealing ring 73 on the inner side of the peripheral wall 52 of the moving plate 50 and the outer sealing ring 74 on the outer side of the peripheral wall 52 make close elastic contact with the sealing surface 70 of the female housing 10 and the sealing surface 71 of the male housing 30 respectively. Thus, gaps between the female and male housings 10 and 30 are sealed.

The female and male connectors F and M may have to be separated from each other for maintenance. As a result, the female and male connectors F and M are unlocked from each other, and the lever 22 is rotated from the rotational termination position to the rotational starting position. The reverse rotation of the lever 22 generates a cam action between the follower pin 39 and the cam groove 25, and a force is applied to move the female housing 10 out of the hood 32.

Three lips 77 are formed on the inner sealing ring 73 on the moving plate 50. However, only two lips 77 are formed on the outer sealing ring 74 on the moving plate 50. Thus, the frictional force between the outer sealing ring 74 and the sealing surface 71 of the male housing 30 is less than the frictional force between the inner sealing ring 73 and the sealing surface 70 of the female housing 10. As described above, a cam action may be generated to apply a force to the female housing 10 for slipping the female housing 10 out of the male housing 30. Consequently, the outer sealing ring 74, having a lower frictional force, separates from the sealing surface 71 of the hood 32. However, the higher frictional force of the inner sealing ring 73 enables the moving plate 50 and the female housing 10 to move together from the male housing 30. The front surface of the second engaging hole 44 is a gentle tapered surface 44A. Thus, the elastic engaging piece 59 deforms elastically and disengages from the second engaging hole 44 easily, and the moving plate 50 is drawn out forward.

The moving plate 50 is returned to the initial position, together with the female housing 10, when the lever 22 is rotated to the rotational starting position. As a result, the engaging projection 60 of the elastic engaging piece 59 fits in the first engaging hole 43, as shown in FIGS. 11 and 12, to prevent the moving plate 50 from moving forward from the initial position. The to-be-locked claw 66 of the moving plate 50 presses the locking projection 48 and elastically deforms the locking piece 47 as the moving plate 50 moves forward. However, the to-be-locked claw 66 passes the locking projection 48 when the moving plate 50 returns to the initial position. Thus, as shown in FIG. 10, the to-be-locked claw 66 is locked to the locking surface 48A of the locking projection 48 of the locking piece 47 to prevent the moving plate 50 from moving rearward in the male housing 30.

The female connector F is withdrawn from the male connector M when the moving plate 50 is returned to the initial position. The frictional force between the outer sealing ring 74 and the sealing surface 71 of the male housing 30 is less than the locking force of the semi-locking construction defined by the elastic engaging piece 59 and the first engaging hole 43. Therefore, as shown in FIGS. 2 and 3, the outer sealing ring 74 is separated from the sealing surface 70 and the female housing 10 is drawn out of the moving plate 50, but the moving plate 50 is held at the initial position.

As described above, the front projected walls 56 of the moving plate 50 slide in contact with the four corners of the inner peripheral surface of the hood 32 as the moving plate 50 is pressed from the initial position to the termination position. Additionally, the rear projected walls 57 at the upper and lower peripheral edges of the rear surface of the body 51 slide in contact with the insertion groove 41 formed on the rear wall of the hood 32. Furthermore, the three peripheral surfaces of the rib 45 that projects forward in the hood 32 slide in contact with the inner peripheral surfaces of the guide walls 64, 65 formed on the periphery of the insertion hole 62 of the moving plate 50. Thus, the moving plate 50 is pressed smoothly into the male housing 30.

More particularly, inner portions of the moving plate 50 have structure for preventing tilting or shaking. Thus, the construction of the present invention allows the span between the portions that preventing tilting to be short as compared with moving plates that have structure for preventing tilting only the peripheral wall. Further the rib 45 sliding a long distance in contact with the inner peripheral surface of the guide walls 64, 65. Thus, shaking of the moving plate 50 is minimized and the moving plate 50 can be pressed smoothly into the male housing 30. Furthermore the rib 45, the insertion hole 62, and the guide walls 64, 65 are provided in a dead space. Therefore the construction enables the female connector F and the male connector M to be small.

The to-be-locked claw 66 is locked elastically to the locking surface 48A of the locking projection 48 of the locking piece 47. Thus, the moving plate 50 is prevented from moving rearward from the initial position. The to-be-locked claw 66 is formed on the guide wall 65. Thus, the male housing 30 is compact and the to-be-locked claw 66 is reinforced.

Further the construction of fitting the rib 45 in the fit-in groove 28 of the female housing 10 prevents the female housing 10 and the male housing 30 from being connected in an inverted orientation.

The invention is not limited to the above-described embodiment described above with reference to the drawings. For example, the following embodiments are included in the technical scope of the present invention. Further, various modifications of the above-described embodiment can be made without departing from the spirit and scope of the present invention.

In the above-described embodiment, the rib and the elastic locking piece are formed adjacently to each other and inserted to the common insertion hole. But the rib and the elastic locking piece may be spaced at a certain interval and inserted into separate insertion holes.

The rib and the insertion hole may be formed at two or more positions. As the number of the ribs and the insertion holes increase, the span between the portions for preventing tilting of the moving plate can be increasingly made short. Thereby shaking of the moving plate can be effectively prevented.

Even though the guide wall is not formed on the periphery of the insertion hole, it is possible to shorten the span between the portions for preventing tilting of the moving plate and effectively prevent the moving plate from shaking, so long as the rib is capable of sliding in contact with the periphery of the insertion hole.

The invention is applicable to a connector with a moving plate, but no lever.

The invention is applicable to a connector that is not of a hybrid type, but accommodates only one kind of terminal fitting.

What is claimed is:

1. A connector comprising:

a male housing having a terminal accommodation part and a hood projecting forward from the terminal accommodation part, a rib and an elastic locking piece projecting forward from the terminal accommodation part and into hood;

male terminals accommodated in the terminal accommodation part, the male terminals having tabs projecting forward into said hood; and a moving plate movably disposed in the hood for movement from an initial position where the moving plate is spaced forward from the terminal accommodation part to a termination position where the moving plate is substantially adjacent the terminal accommodation part, the moving plate having holding holes for receiving the tabs of the male terminals and an insertion hole for slidably receiving the rib and the elastic locking piece as the moving plate moves from the initial position to the termination position, whereby the rib smoothly guides the moving plate from the initial position to the termination position.

2. The connector of claim 1, wherein the rib and the insertion hole are configured to permit insertion of the moving plate into the hood in only one rotational orientation.

3. The connector of claim 1, further comprising a to-be-locked portion formed on said moving plate for engagement with the elastic locking piece to prevent said moving plate from moving rearward from the initial position.

4. The connector of claim 3, further comprising at least one guide wall projecting from the moving plate along a periphery of the insertion hole for sliding engagement with the rib.

5. The connector of claim 4, wherein the to-be-locked portion is formed on the guide wall.

6. The connector of claim 1, wherein the moving plate has a main body, the holding holes and the insertion hole being formed through the main body.

7. The connector of claim 6, wherein the moving plate further comprises at least one rear projected wall projecting rearward from the main body and being slidably engaged with inner peripheral surfaces of the hood.

8. The connector of claim 6, wherein the moving plate further comprises at least one front projected wall projecting forward from the main body and being slidably engaged with inner peripheral surfaces of the hood.

9. The connector of claim 8, wherein the moving plate further comprises at least one rear projected wall projecting rearward from the main body and being slidably engaged with inner peripheral surfaces of the hood.

10. The connector of claim 1, further comprising a female housing having a front end configured for insertion into the hood and for engaging the moving plate for pushing the moving plate from the initial position to the termination position.

11. The connector of claim 10, further comprising a fit-in groove formed in the front end of the female housing and configured for receiving the rib as the female housing is inserted into the hood of the male housing.

12. The connector of claim 11, wherein the moving plate has a main body, the holding holes and the insertion hole being formed through the main body, at least one peripheral wall projecting forward from the main body of the moving plate, the front end of the female housing being configured to nest inwardly of the at least one peripheral wall.

13. A connector comprising:

a male housing having a terminal accommodation part and a hood projecting forward from the terminal accommodation part, a rib projecting forward from the terminal accommodation part and into hood;

male terminals accommodated in the terminal accommodation part, the male terminals having tabs projecting forward into said hood;

a moving plate movably disposed in the hood for movement from an initial position where the moving plate is spaced forward from the terminal accommodation position to a termination position where the moving plate is substantially adjacent the terminal accommodation part, the moving plate having a main body formed with holding holes for receiving the tabs of the male terminals and an insertion hole for slidably receiving the rib, at least one peripheral wall projecting forward from the main body of the moving plate;

a female housing having a front end configured for insertion into the hood and for engaging the moving plate for pushing the moving plate from the initial position to the termination position, fit-in groove being formed in the front end of the female housing and configured for receiving the rib as the female housing is inserted into the hood of the male housing, the front end of the female housing further being configured to nest inwardly of the peripheral wall; and an inner seal disposed around an inner peripheral surface of the peripheral wall for sealing engagement with the female housing and an outer seal disposed around an outer peripheral surface of the moving plate for sealing engagement with the hood.

14. The connector of claim 13, further comprising an elastic locking piece projecting forward from the terminal accommodation part and into the hood, the elastic locking piece being disposed and configured for passing through the insertion hole of said moving plate as the moving plate moves from the initial position to the termination position.

15. The connector of claim 13, wherein the inner and outer seals are formed from an elastomer and wherein the moving plate is formed from a hard synthetic resin.

16. The connector of claim 15, wherein the inner and outer seals are molded integrally with the moving plate to define an integral matrix of the elastomer and the hard synthetic resin.

17. The connector of claim 16, wherein the inner seal has a plurality of inwardly projecting lips, and wherein the outer seal has a plurality of outwardly projecting lips, the lips being formed to define greater frictional force between the inner seal and the female housing than between the outer seal and the hood.

* * * * *